US005823234A

United States Patent [19]

Boertz

[11] Patent Number: 5,823,234

[45] Date of Patent: Oct. 20, 1998

[54] PROCESS FOR FILLING CONTAINERS WITH A PRESSURIZED LIQUID

[75] Inventor: Detlef Boertz, Schwablisch Hall, Germany

[73] Assignee: Robert Bosch GmbH, Stuttgart, Germany

[21] Appl. No.: 776,948

[22] PCT Filed: Jun. 3, 1996

[86] PCT No.: PCT/DE96/01037

§ 371 Date: Feb. 13, 1997

§ 102(e) Date: Feb. 13, 1997

[87] PCT Pub. No.: WO97/00224

PCT Pub. Date: Jan. 13, 1997

[30] Foreign Application Priority Data

Jun. 16, 1995 [JP] Japan ..... 7-150670

[51] Int. Cl.[6] ..... B67C 3/20

[52] U.S. Cl. ..... 141/67; 141/1; 141/244

[58] Field of Search ..... 141/1, 67, 83, 141/95, 102, 237, 242, 244, 245

[56] References Cited

U.S. PATENT DOCUMENTS

| | | | |
|---|---|---|---|
| 2,791,353 | 5/1957 | Dorn et al. | 141/244 |
| 4,557,301 | 12/1985 | Jorss | 141/102 |
| 4,859,375 | 8/1989 | Lipisko et al. | 141/83 |
| 4,890,774 | 1/1990 | Poore | 141/102 |
| 5,148,841 | 9/1992 | Graffin | 141/83 |
| 5,156,193 | 10/1992 | Baruffato et al. | 141/1 |
| 5,335,705 | 8/1994 | Morishita et al. | 141/67 |

*Primary Examiner*—J. Casimer Jacyna

*Attorney, Agent, or Firm*—Edwin E. Greigg; Ronald E. Greigg

[57] ABSTRACT

A filling machine for filling liquid into containers (10) has a filling valve (25) for each container (10), which valve is actuated by a control device (19) by means of a trigger pulse (Z). In order to increase the precision of the liquid quantity (M (is)) filled into the containers (10) with regard to a desired fill quantity (M), it is proposed that the control device (19) adds up partial volumes (ΔM), which are produced as a function of liquid pressures (P1) measured, the time intervals (Δt) between the individual pressure measurements, and a pressure/through flow characteristic curve of the filling valves (25). As soon as the sum of the partial volumes (ΔM) has exceeded a limit fill quantity (M (max)), the control device (19) stops the trigger signal (Z).

20 Claims, 1 Drawing Sheet

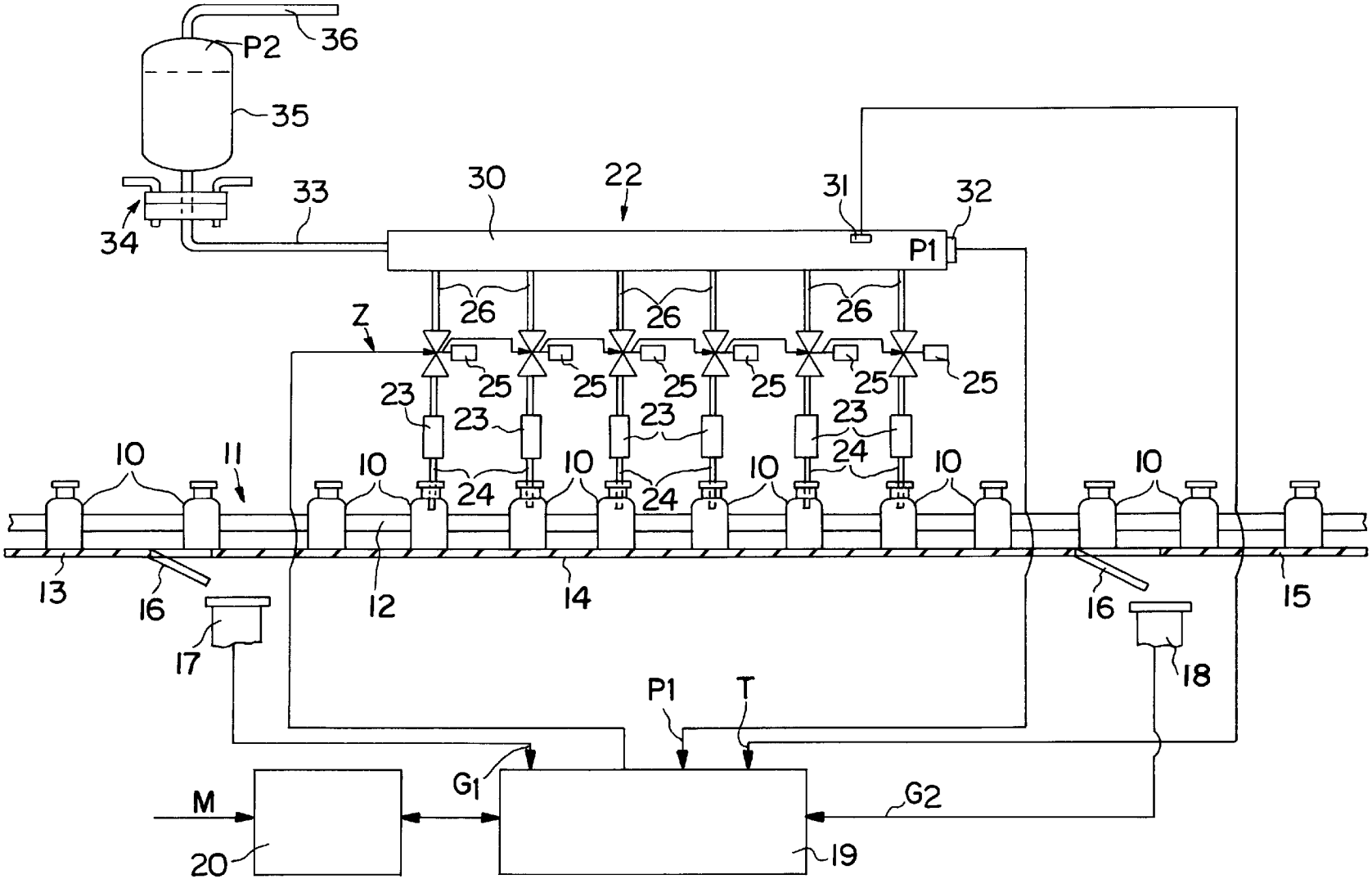
15
18
10
16
32
P1
25
10
G2
31
26
23
24
19
T
P1
22
14
30
G1
12
Z
36
33
35
P2
11
17
M
20
34
13

PROCESS FOR FILLING CONTAINERS WITH A PRESSURIZED LIQUID

PRIOR ART

The invention is based on a process for filling containers with a pressurized liquid, according to the preamble to claim 1. JP 10 46 392 B4 has already disclosed a process of this kind. In this process, the liquid pressure is measured once after the opening of a filling valve, whereupon a control device calculates a filling time or opening time for the filling valve for a particular fill quantity based on the liquid pressure measured. In the known process, it is disadvantageous that pressure fluctuations occurring during the filling process, which lead to a change in the through flow quantity at the filling valve, are not taken into account. Furthermore, the fill quantities during the opening and closing process of the filling valve are also not taken into account. The precision of the known filling process is therefore limited.

ADVANTAGES OF THE INVENTION

The process according to the invention for filling containers with a pressurized liquid, has the advantage over the prior art that it functions in a very precise manner. This is achieved according to the invention by virtue of the fact that the liquid pressure is continuously measured during the filling process so that pressure fluctuations that occur can be taken into account. Furthermore, the through flow quantities during the opening and closing process of the filling valve can also be detected, and can be taken into account in the calculation of filling volumes.

Further advantages and advantageous improvements of the process according to the invention for filling containers with pressurized liquid are set forth in the following description.

BRIEF DESCRIPTION OF THE DRAWING

An exemplary embodiment of the invention is shown in the drawing and described in detail in the ensuing description. The sole FIGURE shows a schematic representation of a filling machine.

DESCRIPTION OF THE EXEMPLARY EMBODIMENT

The filling machine shown in FIG. 1 for metering and filling a liquid into packaging containers 10 has a feed device 11 with which packaging containers 10, for example ampules or vials, are supplied to treatment stations disposed in succession. The feed device 11 has a spiral conveyor 12 for the cyclical or continuous transport of packaging containers 10. The packaging containers 10 stand and slide on sections of track 13 to 15. A weighing device 17, 18 for each respective packaging container 10, which device can be controlled via a discharge device 16, is disposed between the respective sections of track 13 and 14 or 14 and 15, of which weighing devices, the one weighing device 17 detects the tare weight G1 and the other weighing device 18 detects the gross weight G2 of the packaging container 10 and sends it to a control device 19 as an input quantity.

For example, product specific data such as the viscosity progression of the liquid over temperature as well as data of the device are stored in the control device 19. An input/output unit 20 is connected to the control device 19, via which unit in particular the desired fill quantity M or a desired fill weight of the packaging container 10 can be input into the control device 19.

A filling device 22 is disposed above the feed device 11 in the region of track section 14. In a cyclical transport of packaging containers 10, the filling device 22 includes a number of filling heads 23 that corresponds to the number of packaging containers 10 to be filled per cycle, for example six, each of the filling heads has a hollow filling needle 24 that can be raised and lowered. Each filling head 23 is coupled with a metering valve 25 for the liquid, wherein all of the metering valves 25 can be synchronously controlled in common by the control device 19. The metering valves 25 communicate via short lines 26 with a common, tubular distributor 30 in which a liquid pressure P1 prevails. For its part, the distributor 30 is connected to a reservoir 35 for the liquid via a line 33 and a quick catch device 34. The pressure difference between the distributor 30, which is completely filled with the liquid, and the individual metering valves 25 is always the same magnitude, for example due to a disposition of the metering valves 25 at the same vertical spacing from the distributor 30, and the pressure value is stored in the control device 19 as a factor.

The reservoir 35 advantageously contains the quantity of liquid that is required during a production phase for filling the packaging containers 10. As a result, it turns out that the fill level in the reservoir 35 decreases with each filling cycle only by a very slight measure. The reservoir 35 is acted upon with a gas pressure P2 via a pressure line 36.

An influence advantageously exists between the pressures P1 and P2 so that P2 is regulated, for example by the control device 19 so that a pressure P1 is continuously adjusted, whose tolerance is for example ±0.05 bar. Consequently, different dispositions of the reservoir 35 on the filling machine as well as a decreasing fluid level in the reservoir 35 can be compensated for.

A higher pressure of the liquid at the metering valves 25, and thus a great discharge speed from the reservoir 35 is generally made possible by the pressure P2, which encourages the flow behavior, particularly with highly viscous liquids.

A temperature sensor 31 for detecting a liquid temperature T and a pressure sensor 32 for detecting the liquid pressure P1 are disposed in the distributor 30. The two sensors 31, 32 are likewise connected to the control device 19.

It is significant that in particular the liquid pressure P1 is measured continuously at particular time intervals of $\Delta t$, for example every 150 $\mu$sec to every 250 $\mu$sec, and is supplied to the control device 19 as an input quantity. The duration of the time intervals $\mu t$ between the individual measurements of the liquid pressure P1 should be selected so that even during the opening and closing process of the metering valve 25, liquid pressures P1 are detected and transmitted to the control device 19. For these reasons, a value of 200 $\mu$sec has proven worthwhile for $\Delta t$, which assures a sufficient solution even during the opening and closing process of the filling valves 25.

The above described device works as follows: The packaging containers 10 are supplied cyclically to the filling device 22 by the spiral conveyor 21. As soon as each packaging container 10 is positioned under its associated filling head 23, the filling needles 24 of the filling heads 23 are lowered and introduced into the packaging containers 10. At the same time, through a corresponding trigger signal Z to the metering valves 25 by means of the control device 19, the filling of the desired fill quantity M is introduced into the packaging containers 10, i.e. the trigger signal Z causes a coil in the metering valve 25 to be supplied with power so that its needle lifts up from the valve seat.

The calculation of the fill quantity M (ist) filled, and consequently the duration of the trigger signal Z to the metering valves 25, is carried out by virtue of the fact that partial volumes ΔM are continuously calculated by the control device 19 and added up while the trigger signal Z lasts. The partial volumes ΔM are calculated from the time intervals At between the individual measurements of the liquid pressures P1, from the respective value of the liquid pressure P1 supplied to the control device 19, and from a function interrelationship k (p1) between the individual value P1 and the resultant through flow quantity per unit of time in the metering valves 25, which function is stored in the control device 19.

The control device 19 consequently calculates the fill quantity M that is filled into a container 10 according to the following formula:

$$M(\text{ist})=\Sigma\Delta M=\Sigma(P1*\Delta t*k)$$

If M (ist), i.e. the sum of the partial volumes ΔM, exceeds a particular limit value M (max), then the trigger signal Z for the metering valves 25 is stopped by the control device 19 and the metering valves 25 close. In the simplest case, this limit value M (max), which brings about the end of the trigger signal Z, is the desired fill quantity M itself. The limit value M (max) stored in the control device 19 can be selected corresponding to the closing characteristic curve of the filling valves 25, but can also be selected as smaller so that for example the fill quantity or the partial volumes AM can also be taken into consideration, which arrive in the containers 10 during the closing process of the metering valves 25 (after the absence of the trigger signal Z). This means that in this case, the limit value M (max) is less than the desired fill quantity M.

The precision of the partial volume calculation AM of the control device 19 is increased by taking into account the liquid temperature T detected by the temperature sensor 31. This is achieved by virtue of the fact that the through flow/viscosity characteristic curves for the respective liquid are stored in the control device 19 so that the corresponding temperature-corrected function interrelationship k is accessed for the calculation of the individual partial volumes ΔM, i.e. so that the value of the factor k is also dependent upon the temperature [k(P1, T)].

After the desired fill quantity M is put into the packaging containers 10, the filling needles 24 are lifted out of the packaging containers 10 once more by the filling heads 23. Then the packaging containers 10 are cyclically supplied by the feed spiral 12 to another processing station, for example a closing station. At the same time, the process as described above repeats for packaging containers 10 that have been newly fed into the filling machine.

In order to control or regulate the exact metering of the liquid quantity and thus the desired fill quantity M by means of the filling machine, individual packaging containers 10 are removed via the discharge devices 16 as random samples and supplied to the weighing devices 17, 18. The actually metered liquid quantity M (ist) is calculated by the control device 19 as the difference between the gross weight G2 and the tare weight G1. With the aid of so-called statistical process control (SPC), it is possible for the control device 19 to determine a correspondingly corrected trigger signal Z for the metering valves 25 when defined engagement limits, for example of the liquid quantity M (ist), but also of the tare weight G1 of the packaging container 10, are exceeded or fallen short of.

It is additionally noted that it is, in principle, sufficient to detect the value of the liquid pressure P1 only during the actual filling process. As a rule and for control purposes in the event of possible malfunctions of the filling machine, though, the liquid pressure P1 is continuously measured and supplied to the control device 19.

Furthermore, it is also conceivable to select the time intervals At as large so that the opening and closing process of the metering valves 25 with regard to the partial volumes ΔM is no longer exactly taken into consideration and in this case, to assume fixed partial volumes ΔM (fixed) for the opening and closing of the metering valves 25 (corresponding to the metering valve characteristic curve). Even in this case, the precision is improved in comparison to known filling processes since pressure fluctuations during the actual filling are taken into account.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A process for filling containers (10) with a liquid under pressure (P1) which comprises supplying a liquid contained within a pressurized reservoir (35) to a distributor (30) connected with said pressurized reservoir so as to completely fill the distributor with liquid, simultaneously supplying the liquid from said distributor to respective filling valves, measuring the pressure of the liquid contained within said distributor, transmitting the measured pressure (P1) to a control device (19) to which a signal representative of a desired fill quantity has been directed to produce a trigger output (Z) of said control device, directing the trigger output (Z) to each of said filling valves to simultaneously actuate each of said filling valves to fill said liquid in respective containers, continuously measuring the pressure (P1) at particular intervals (Δt) during the filling said containers, calculating actual filled fill quantities (M) from a sum of partial volumes (ΔM), which sum is produced taking into account the respectively measured pressure (P1) of the liquid, the time intervals (Δt) between the individual pressure measurements, and a pressure flow characteristic curve (k) of the filling valves (25), and stopping the trigger signal from the control device (19) to the metering valves (25) when a fill limit quantity (M (max)) has been obtained.

2. A process according to claim 1, in which the time intervals (Δt) between the individual measurements of the liquid pressure (P1) are constant.

3. A process according to claim 2, in which the time intervals (Δt) are from about between 150 μsec to about 250 μsec.

4. A process according to claim 3, in which the trigger signal (Z) for actuating the filling valve (25) is stopped at a fill limit quantity (M (max)), which is smaller than the desired fill quantity (M).

5. The process according to claim 3, in which the trigger signal (Z) for actuating the filling valve (25) is stopped at a fill limit quantity (M (max)), which corresponds to the desired fill quantity (M).

6. A process according to claim 2, in which the time intervals (Δt) are about 200 μsec.

7. A process according to claim 6, in which the trigger signal (Z) for actuating the filling valve (25) is stopped at a fill limit quantity (M (max)), which is smaller than the desired fill quantity (M).

8. The process according to claim 6, in which the trigger signal (Z) for actuating the filling valve (25) is stopped at a fill limit quantity (M (max)), which corresponds to the desired fill quantity (M).

9. A process according to claim 6, in which the partial volumes (ΔM) are calculated taking into account a temperature (T) measured in the liquid by means of a temperature sensor (31).

10. A process according to claim 2, in which the trigger signal (Z) for actuating the filling valve (25) is stopped at a fill limit quantity (M (max)), which is smaller than the desired fill quantity (M).

11. The process according to claim 2, in which the trigger signal (Z) for actuating the filling valve (25) is stopped at a fill limit quantity (M (max)), which corresponds to the desired fill quantity (M).

12. A process according to claim 1, in which the pressure (P1) of the liquid is measured during an entire service life of a filling machine.

13. A process according to claim 12, in which the partial volumes (ΔM) are calculated taking into account a temperature (T) measured in the liquid by means of a temperature sensor (31).

14. A process according to claim 1, in which the trigger signal (Z) for actuating the filling valve (25) is stopped at a fill limit quantity (M (max)), which is smaller than the desired fill quantity (M).

15. A process according to claim 14, in which the partial volumes (ΔM) are calculated taking into account a temperature (T) measured in the liquid by means of a temperature sensor (31).

16. The process according to claim 1, in which the trigger signal (Z) for actuating the filling valve (25) is stopped at a fill limit quantity (M (max)), which corresponds to the desired fill quantity (M).

17. A process according to claim 16, in which the partial volumes (ΔM) are calculated taking into account a temperature (T) measured in the liquid by means of a temperature sensor (31).

18. A process according to claim 1, in which predetermined volumes (AM fixed) are assumed for the opening and closing process of the filling valve (25) so that no partial volumes (ΔM) are calculated during the open time of the filling valve.

19. A process according to claim 18, in which the partial volumes (ΔM) are calculated taking into account a temperature (T) measured in the liquid by means of a temperature sensor (31).

20. A process according to claim 1, in which the partial volumes (ΔM) are calculated taking into account a temperature (T) measured in the liquid by means of a temperature sensor (31).

* * * * *